US010597874B2

(12) United States Patent
Izumi et al.

(10) Patent No.: US 10,597,874 B2
(45) Date of Patent: Mar. 24, 2020

(54) METAL ROOFING MATERIAL, AND ROOFING STRUCTURE AND ROOFING METHOD USING SAME

(71) Applicant: Nisshin Steel Co. Ltd., Tokyo (JP)

(72) Inventors: Keiji Izumi, Tokyo (JP); Yuugo Oota, Tokyo (JP); Tomoyuki Nagatsu, Tokyo (JP); Norimasa Miura, Tokyo (JP); Katsunari Norita, Tokyo (JP); Kenichi Okubo, Tokyo (JP); Motonori Kurotaki, Tokyo (JP)

(73) Assignee: Nippon Steel Nisshin Co., Ltd., Tokyo (JP)

( * ) Notice: Subject to any disclaimer, the term of this patent is extended or adjusted under 35 U.S.C. 154(b) by 0 days.

(21) Appl. No.: 15/778,100

(22) PCT Filed: Mar. 24, 2016

(86) PCT No.: PCT/JP2016/059384
§ 371 (c)(1),
(2) Date: May 22, 2018

(87) PCT Pub. No.: WO2017/090257
PCT Pub. Date: Jun. 1, 2017

(65) Prior Publication Data

US 2019/0264448 A1 Aug. 29, 2019

(30) Foreign Application Priority Data

Nov. 27, 2015 (JP) ..... 2015-231569

(51) Int. Cl.
*E04D 1/18* (2006.01)
*E04D 1/20* (2006.01)
*E04D 1/24* (2006.01)

(52) U.S. Cl.
CPC ..... *E04D 1/18* (2013.01); *E04D 1/20* (2013.01); *E04D 1/24* (2013.01)

(58) Field of Classification Search
CPC ..... E04D 1/18; E04D 1/20; E04D 1/24
See application file for complete search history.

(56) References Cited

U.S. PATENT DOCUMENTS 157,392 A * 12/1874 Hamel ..... E04F 13/0864 52/539
460,283 A * 9/1891 Adler ..... E04F 13/0864 52/316

(Continued)

FOREIGN PATENT DOCUMENTS

AU 2015389616 9/2017
AU 2016330878 4/2018

(Continued)

OTHER PUBLICATIONS

International Search Report and Written Opinion, counterpart International Appl. No. PCT/JP2016/059384, dated Jun. 7, 2016, with English translation of the International Search Report and partial translation of Written Opinion (7 pages).

(Continued)

*Primary Examiner* — James M Ference
(74) *Attorney, Agent, or Firm* — Cook Alex Ltd.

(57) ABSTRACT

A body portion 100 of a front substrate 10 includes first side surfaces 105 and second side surfaces 106, each of the second side surfaces 106 being arranged at a position protruding toward the outer side along a width direction 100*a* than the first side surface 105. Each of the first side surfaces 105 includes a side flange 105*a*. A protruding width of the side flange 105*a* from the first side surface 105 is equal to or less than a protruding width of the second side surface 106 from the first side surface 105. A metal roofing (Continued)

member 1 is arranged on a roof base while abutting at least the second side surface 106 against a second side surface of other metal roofing member.

18 Claims, 7 Drawing Sheets

(56) References Cited

U.S. PATENT DOCUMENTS 1,519,350 A * 12/1924 Belding ..... E04D 1/18 52/522
2,065,478 A * 12/1936 Schulman ..... E04D 1/24 52/22
2,882,840 A * 4/1959 Waske ..... E04D 1/125 52/530
2,961,804 A * 11/1960 Beckman ..... E04C 2/26 52/539
3,312,031 A * 4/1967 Berg ..... E04D 3/30 52/316
3,394,515 A * 7/1968 Widdowson ..... E04D 3/38 52/394
3,667,184 A * 6/1972 Merrill ..... E04D 1/18 52/530
3,760,546 A * 9/1973 Martin ..... E04D 1/265 52/309.9
4,079,561 A * 3/1978 Vallee ..... E04D 1/125 52/520
4,218,857 A * 8/1980 Vallee ..... E04D 1/18 52/530
4,244,353 A * 1/1981 Straza ..... E04D 1/24 126/622
4,445,305 A * 5/1984 Orie, Sr. ..... E04D 13/165 52/309.9
4,817,704 A * 4/1989 Yamashita ..... F24H 7/002 126/263.03
4,824,714 A * 4/1989 Gest ..... B29C 43/52 156/222
5,146,727 A * 9/1992 Hansson ..... E04C 2/08 52/531
5,349,801 A * 9/1994 Verbofsky ..... E04D 1/265 52/478
5,442,888 A * 8/1995 Ilnyckyj ..... E04D 1/125 52/524
5,469,680 A * 11/1995 Hunt ..... E04D 1/18 52/520
5,495,654 A * 3/1996 Goodhart ..... E04D 1/06 29/428
5,613,337 A * 3/1997 Plath ..... E04D 1/18 52/533
5,625,999 A * 5/1997 Buzza ..... E04C 2/296 52/309.11
5,711,127 A * 1/1998 Sabourin ..... E04D 1/18 52/519
5,784,848 A * 7/1998 Toscano ..... E04D 1/265 52/519
5,799,460 A * 9/1998 Jensen ..... E04D 1/18 52/460
5,842,315 A * 12/1998 Lin ..... B32B 3/28 52/309.9
5,956,913 A * 9/1999 Nicholson ..... E04D 1/18 52/520
6,173,546 B1 * 1/2001 Schafer ..... E04D 1/125 52/519
6,557,315 B2 * 5/2003 Tremblay ..... E04D 1/125 52/520
6,619,006 B1 * 9/2003 Shirota ..... E04D 1/18 52/520
6,708,463 B2 * 3/2004 Chai ..... E04D 1/06 52/470
6,883,290 B2 * 4/2005 Dinwoodie ..... E04D 1/18 52/748.1
7,980,036 B2 * 7/2011 Takayasu ..... E04F 13/12 52/506.01
8,191,326 B2 * 6/2012 Shapiro ..... B44C 1/28 52/506.05
8,590,251 B2 * 11/2013 Bandera ..... E04F 13/0876 52/545
8,898,963 B1 * 12/2014 Amatruda ..... E04D 1/26 52/409
9,091,082 B2 * 7/2015 Wakebe ..... E04D 1/06
9,598,857 B2 * 3/2017 Smith ..... E04B 1/803
2005/0074581 A1 * 4/2005 Albright ..... E04D 1/20 428/151
2006/0053709 A1 * 3/2006 Kim ..... E04D 1/125 52/204.52
2009/0186541 A1 * 7/2009 Carolan ..... E04C 2/292 442/38
2010/0186334 A1 * 7/2010 Seem ..... E04D 1/18 52/539
2011/0293914 A1 * 12/2011 Maurer ..... B29C 44/569 428/304.4
2014/0069036 A1 * 3/2014 Noton ..... E04D 1/04 52/173.3
2014/0190104 A1 * 7/2014 Nicholson ..... E04D 1/18 52/302.1
2015/0089885 A1 * 4/2015 Wakebe ..... E04D 1/18 52/105
2015/0218817 A1 * 8/2015 Pisani ..... E04D 1/14 428/99
2018/0066432 A1 * 3/2018 Izumi ..... E04D 1/18
2018/0080228 A1 * 3/2018 Izumi ..... E04D 1/18
2019/0119917 A1 * 4/2019 Okubo ..... E04D 1/18

FOREIGN PATENT DOCUMENTS

| | | |
|---|---|---|
| CN | 2152761 | 1/1994 |
| CN | 200958265 | 10/2007 |
| CN | 204112610 | 1/2015 |
| EP | 3342951 | 7/2018 |
| JP | H01-158165 | 6/1989 |
| JP | H10-306548 | 11/1998 |
| JP | 2002-309752 | 10/2002 |
| JP | 2003-74147 | 3/2003 |
| JP | 2003-74163 | 3/2003 |
| JP | 2006-257783 | 9/2006 |
| JP | WO2013/054571 | 4/2013 |
| WO | WO2016/157555 | 10/2016 |
| WO | WO2017/056630 | 4/2017 |

OTHER PUBLICATIONS

Office Action issued by the Eurasian Patent Office in counterpart Eurasian App. No. 201890871/31, dated Sep. 12, 2018, with English translation (5 pages).
Examination Report, counterpart AU Pat. App. No. 2016360048, dated Jun. 27, 2018 (6 pages).
International Preliminary Report on Patentability, counterpart International Appl. No. PCT/JP2016/059384, dated Jun. 7, 2018 (6 pages).
Office Action issued by the Eurasian Patent Office in counterpart Eurasian App. No. 201890871/31, dated Dec. 24, 2019 with English translation (12 pages).
Office Action issued by the Chinese Patent Office for Chinese Publication No. 201680069135, dated Feb. 3, 2019 with English translation (11 pages).

* cited by examiner

[FIG. 1]
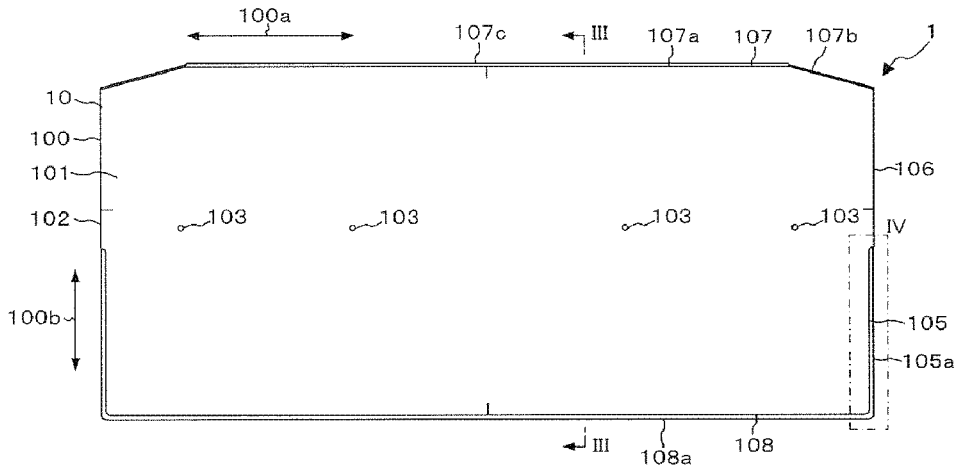

[FIG. 2]
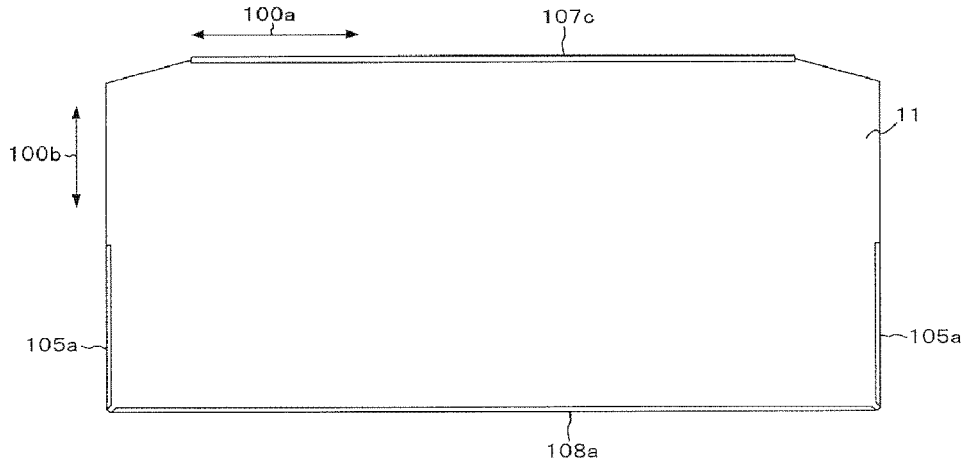

[FIG. 3]
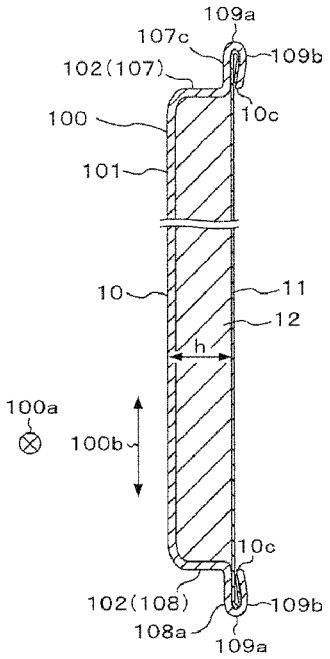

[FIG. 4]
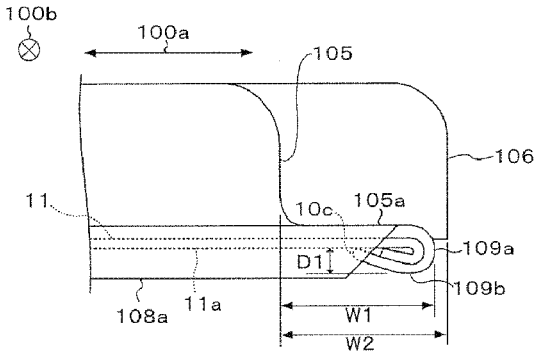

[FIG. 5]
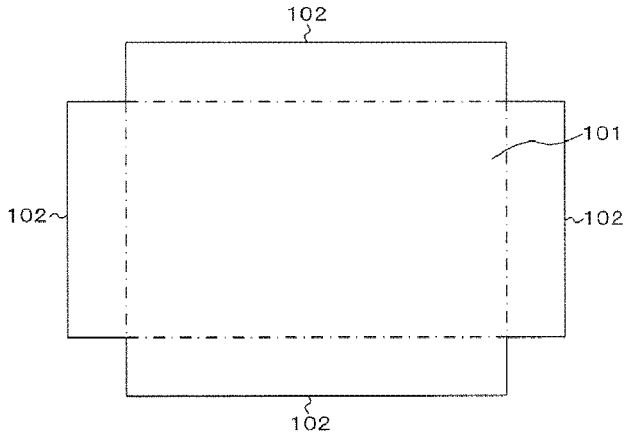

[FIG. 6]
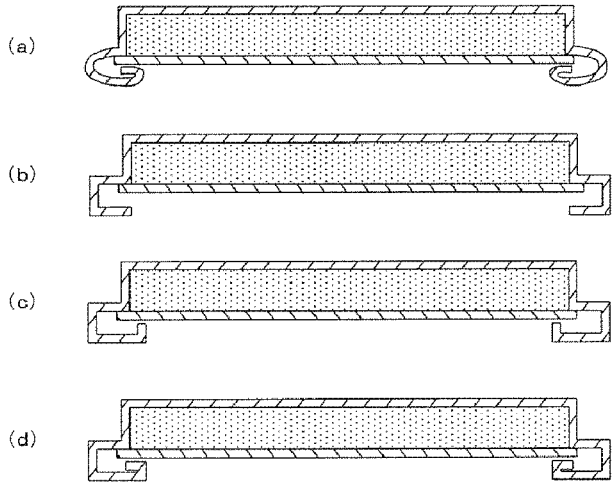

[FIG. 7]
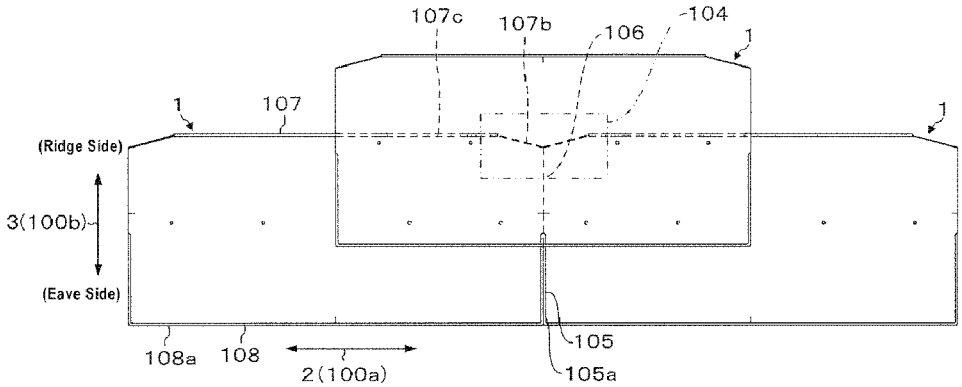

METAL ROOFING MATERIAL, AND ROOFING STRUCTURE AND ROOFING METHOD USING SAME

The present application is a U.S. National Stage of PCT International Patent Application No. PCT/JP2016/059384, filed Mar. 24, 2016, which claims priority to JP Application No. 2015-231569, filed Nov. 27, 2015, both of which are hereby incorporated herein by reference.

TECHNICAL FIELD

The present invention relates to a metal roofing material (member) that is disposed together with other metal roofing members on a roof base, and to a roofing structure and a roofing method that utilize the metal roofing member.

BACKGROUND ART

Conventionally, this type of metal roofing member is considered and disclosed. For example, the following structure is disclosed in Patent Document 1. That is, the conventional metal roofing member includes a front substrate in which a metal sheet is formed into a box shape. Roofing of a house is carried out by arranging side by side, on a roof base, a plurality of metal roofing members, while abutting respective side surfaces of the front substrates against each other.

CITATION LIST

Patent Document 1: Japanese Patent Application Publication No. 2003-74147 A

SUMMARY OF INVENTION

Technical Problem

The front substrate in such a conventional metal roofing member is box-shaped, and thus causes the following problems for practical use. That is, the box-shaped front substrate has a constant thickness in order to ensure functionality as a roofing member. Abutting of the entire side surfaces of the front substrates having such a constant thickness against each other will result in a pool of a significant amount of water such as rainwater between the metal roofing members, which will cause corrosion of the metal roofing members and the roof base.

It is also conceivable that flanges are projected from side portions of the front substrate and the flanges are abutted against each other over the entire side portion of each metal roofing member. The flanges also contribute to improvement of strength of the metal roofing member. However, with such a configuration, a space is formed in the upper portion of the flange, so that water may enter the ridge side through this space as a passage.

The present invention has been made to solve the above problems. An object of the present invention is to provide a metal roofing member, and a roofing structure and roofing method that utilize the metal roofing member, which can reduce water pooled between the metal roofing members and can also reduce water entering the ridge side of the metal roofing member, thereby improving the strength of the metal roofing members.

Solution to Problem

The present invention relates to a metal roofing member that is arranged on a roof base together with other metal roofing members, the metal roofing member comprising: a front substrate made of a metal sheet, the front substrate comprising a body portion formed in a box shape; a back substrate arranged on a back side of the front substrate, the back substrate being configured to cover an opening of the body portion; and a core material filled between the body portion and the back substrate; wherein the body portion comprises: first side surfaces; and second side surfaces, each of the second side surfaces being adapted so as to be located on the ridge side of each of the first side surfaces when the metal roofing member is placed on the roof base, each of the second side surfaces being arranged at a position protruding to the outer side along a width direction of the body portion than the first side surface; wherein each of the first side surfaces comprises a side flange, the side flange being formed by folding back the metal sheet toward the back side of the front substrate such that the metal sheet wraps around the back substrate, the metal sheet extending from the lower end of the first side surface toward the outer side along the width direction; wherein the side flange comprising a back end that will be in contact with the roof base; wherein a distance between the back end of the side flange and the back surface of the back substrate is 1 mm or more and 4 mm or less; wherein a protruding width of the side flange from the first side surface is equal to or less than a protruding width of the second side surface from the first side surface; and wherein the metal roofing member is configured to be arranged on the roof base while abutting at least the second side surface against a second side surface of the other metal roofing member.

The present invention relates to a roofing structure comprising a plurality of metal roofing members, each comprising: a front substrate made of a metal sheet, the front substrate comprising a body portion formed in a box shape; a back substrate arranged on the back side of the front substrate, the back substrate being configured to cover an opening of the body portion; and a core material filled between the front substrate and the back substrate; wherein the body portion comprises: first side surfaces; and second side surface, each of the second side surfaces being adapted so as to be located on the ridge side of each of the first side surfaces when the metal roofing member is placed on a roof base, each of the second side surfaces being arranged at a position protruding toward the outer side along the width direction of the body portion than the first side surface; wherein each of the first side surfaces comprises a side flange, the side flange being formed by folding back the metal sheet toward the back side of the front substrate such that the metal sheet extending from the lower end of the first side surface toward the outer side along the width direction wraps around the back substrate; wherein the side flange comprises a back end, the back end being in contact with the roof base; wherein a distance between the back end of the side flange and the back surface of the back substrate is 1 mm or more and 4 mm or less; wherein a protruding width of the side flange from the first side surface is equal to or less than a protruding width of the second side surface from the first side surface; and wherein the plurality of metal roofing members are arranged on the roof base while abutting at least the second side surfaces against each other.

The present invention relates to a roofing method using a plurality of metal roofing members, each of the metal roofing members comprising: a front substrate made of a metal sheet, the front substrate comprising a body portion formed in a box shape; a back substrate arranged on the back side of the front substrate, the back substrate being configured to cover an opening of the body portion; and a core material filled between the front substrate and the back substrate; the body portion comprising: first side surfaces and second side surfaces, each of the second side surfaces being adapted so as to be located on the ridge side of each of the first side surfaces when placed on a roof base, each of the second side surfaces being arranged at a position protruding to the outer side along the width direction of the body portion than the first side surface; each of the first side surface comprising a side flange, the side flange being formed by folding back the metal sheet toward the back side of the front substrate such that the metal sheet wraps around the back substrate the metal sheet extending from the lower end of the first side surface toward the outer side along the width direction; the side flange comprising a back end, the back end being in contact with the roof base; a distance between the back end of the side flange and the back surface of the back substrate being 1 mm or more and 4 mm or less; and a protruding width of the side flange from the first side surface being equal to or less than a protruding width of the second side surface from the first side surface; wherein the method comprises arranging the plurality of metal roofing members on the roof base while abutting at least the second side surfaces against each other.

Advantageous Effects of Invention

According to the metal roofing member, and the roofing structure and roofing method that employ the metal roofing member of the present invention, the metal roofing members are configured to be arranged on the roof base while abutting the second side surface against a second side surface of other metal roofing member, thereby allowing reduction of water pooled between the metal roofing members, and also allowing reduction of water entering the ridge side of the metal roofing member. Further, each of the first side surfaces is provided with the side flange, so that the strength of the metal roofing members can be improved.

BRIEF DESCRIPTION OF DRAWINGS

FIG. 1 is a front view showing a metal roofing member according to Embodiment 1 of the present invention.

FIG. 2 is a rear view showing the metal roofing member of FIG. 1.

FIG. 3 is a cross-sectional view of the metal roofing member taken along the line III-III in FIG. 1.

FIG. 4 is a side view of the metal roofing member when viewing the region IV of FIG. 1 along a depth direction.

FIG. 5 is an explanatory view showing another embodiment of the body portion of FIG.

FIG. 6 is an explanatory view showing another embodiment of the flange of FIG. 1.

FIG. 7 is an explanatory view showing a roofing structure and a roofing method using the metal roofing members of FIGS. 1 to 4.

DESCRIPTION OF THE PREFERRED EMBODIMENTS

Embodiments for carrying out the present invention will be described with reference to the drawings.

Embodiment 1 for Carrying Out the Present Invention

FIG. 1 is a front view showing a metal roofing member 1 according to Embodiment 1 of the present invention, FIG. 2 is a rear view showing the metal roofing member 1 of FIG. 1, FIG. 3 is a cross-sectional view of the metal roofing member 1 taken along the line III-III in FIG. 1, and FIG. 4 is a side view of the metal roofing member 1 when viewing the region IV of FIG. 1 along a depth direction 100*b*. Further, FIG. 5 is an explanatory view showing another embodiment of a body portion 100 of FIG. 1, and FIG. 6 is an explanatory view showing another embodiment of a flange of FIG. 1.

The metal roofing member 1 as shown in FIGS. 1 to 4 is arranged together with other metal roofing members on a roof base of a building such as a house. The metal roofing member 1 is tightened to the roof base by driving tightening members such as, for example screws or nails into the roof base. The metal roofing member 1 is adapted such that its longitudinal direction (a width direction 100*a* of a body portion 100 described below) extends in a direction parallel to an eave of the roof and its short direction (a depth direction 100*b* of the body portion 100 described below) extends along an eave-ridge direction.

As particularly shown in FIG. 3, the metal roofing member 1 includes a front substrate 10, a back substrate 11, and a core material 12.

The front substrate 10 is made of a metal sheet and appears on the outer surface of the roof as the metal roofing material 1 is placed on the roof base. The metal sheet making up the front substrate 10 that can be used includes a hot-dip Zn-based plated steel sheet, a hot-dip Al plated steel sheet, a hot-dip Zn-based plated stainless steel sheet, a hot-dip Al plated stainless steel sheet, a stainless steel sheet, an Al sheet, a Ti sheet, a coated hot-dip Zn-based plated steel sheet, a coated hot-dip Al plated steel sheet, a coated hot-dip Zn-based plated stainless steel sheet, a coated hot-dip Al plated stainless steel sheet, a coated stainless steel sheet, a coated Al sheet or a coated Ti sheet.

Preferably, the thickness of the metal sheet is 0.27 mm or more and 0.5 mm or less. An increasing thickness of the metal sheet will result in increased strength, but increased weight. The thickness of the metal sheet of 0.27 mm or more can ensure strength required for the roofing member, and sufficiently provide wind pressure resistance performance and tread-down properties. The wind pressure resistance performance refers to performance for which the metal roofing member 1 can withstand strong wind without buckling of the metal roofing member 1. The thickness of the metal sheet of 0.5 mm or less can prevent the weight of the metal roofing member 1 from becoming excessive, thereby keeping down the total weight of the roof when equipment such as a solar cell module, a solar water heater, an outdoor unit of an air conditioner and snow melting equipment is provided on the roof.

The front substrate 10 includes a box-shaped body portion 100 having a top plate 101 and peripheral wall portion 102. The body portion 100 is preferably formed by performing drawing or bulging processing on a metal sheet. By forming the box-shaped body portion 100 by performing the drawing or bulging processing, each of the side wall portion 102 can have a wall surface that is continuous in the circumferential direction of the front substrate 10, and any likelihood that water enters the inside of the body portion 100 can be reduced. However, it is also possible to bend the metal sheet having a shape as shown in FIG. 5 along the dashed lines in the figure to form the box-shaped body portion 100.

When the steel sheet (the hot-dip Zn-based plated steel sheet, the hot-dip Al plated steel sheet, the hot-dip Zn-based plated stainless steel sheet, the hot-dip Al plated stainless steel sheet, the stainless steel sheet, the Al sheet, the Ti sheet, the coated hot-dip Zn-based plated steel sheet, the coated hot-dip Al plated steel sheet, the coated hot-dip Zn-based plated stainless steel sheet, the coated hot-dip Al plated stainless steel sheet or the coated stainless steel sheet) is used as the metal sheet of the front substrate 10 and when the body portion 100 is formed by the drawing or bulging processing, the hardness of the peripheral wall portion 102 are increased by work hardening. More particularly, the Vickers hardness of the peripheral wall portion 102 can be increased to about 1.4 to 1.6 times the hardness before the working. The wind pressure resistance performance of the metal roofing member 1 is significantly improved by virtue of the fact that the peripheral wall portion 102 has the wall surface that is continuous in the circumferential direction of the front substrate 10, as described above, and by virtue of the fact that the hardness of the peripheral wall portion 102 is increased by work hardening.

The back substrate 11 is a member that is arranged on the back side of the front substrate 10 so as to covert an opening of the body portion 100. The back substrate 11 that can be used include lightweight materials such as an aluminum foil, aluminum vapor deposited paper, aluminum hydroxide paper, calcium carbonate paper, resin films or glass fiber paper and the like. The use of these lightweight materials for the back substrate 10 allows prevention of an increase in the weight of the metal roofing material 1.

The core material 12 is made of, for example a foamed resin or the like, and is filled between the body portion 100 of the front substrate 10 and the back substrate 11. The filling of the core material 12 between the body portion 100 of the front substrate 10 and the back substrate 3 can lead to a stronger adhesion of the core material 12 to the inside of the body portion 100 as compared with an embodiment where a backing material such as a resin sheet or the like is attached onto the back side of the front substrate 11, so that the performance required for the roofing materials, such as rainfall noise reduction, heat insulation and tread-down properties, can be improved.

The material of the core material 12 includes, but not limited to, for example, urethane, phenol and cyanurate resins. For roofing materials, however, certified noncombustible materials must be used. The test for certification of noncombustible material is conducted by a heat release test according to the cone calorimeter test method defined in ISO 5660-1. If the foamed resin for forming the core material 12 is urethane having a higher calorific value or the like, the thickness of the core material 12 may be decreased, or inorganic expandable particles may be incorporated into the foamed resin.

A height h of the body portion 100 filled with the core material 12 is preferably 4 mm or more and 8 mm or less. The height h of the body portion 100 of 4 mm or more enables sufficiently higher strength of the body portion 100, and improved wind pressure resistance. The height h of 4 mm or more can also provide improved heat insulation properties. The height h of the body portion 100 of 8 mm or less can prevent the organic mass of the core material 12 from becoming excessive, and can allow certification of noncombustible material to be more reliably obtained.

Returning to FIG. 1, the top plate 101 of the body portion 100 includes a plurality of tightening indicators 103 spaced apart from each other along the width direction 100*a* of the body portion 100. The tightening indicators 103 indicate positions for driving tightening members into the metal roofing member 1. Each of the tightening indicators 103 of this embodiment is composed of a concave portion having a circular shape in plane view. However, each of the tightening indicators 103 may adopt any other form in which the operator can visually or tactually recognize the tightening position of the tightening member, such as a convex portion, an opening, or a printed or engraved symbol.

The peripheral wall portion 102 of the body portion 100 is provided with first side surfaces 105, second side surfaces 106, a ridge-side end surface 107, and an eave-side end surface 108.

The first and second side surfaces 105, 106 are provided on both sides of the body portion 100 along the width direction 100*a*, respectively. The second side surface 106 is adapted to be positioned on the ridge side relative to the first side surface 105 when the metal roofing member 1 is placed on the roof base. As particularly shown in FIG. 4, the second side surface 106 is disposed so as to protrude to the outer side of the first side surface 105 along the width direction 100*a* of the body portion 100. A connection wall that extends along the width direction 100*a* is provided between the first and second side surfaces 105, 106. The connecting wall of this embodiment is formed by a slope that is inclined outward along the width direction 100*a* as the connecting wall approaches the second side surface 106 along the depth direction 100*b*. However, the connecting wall may be formed by a wall surface that is parallel to the width direction 100*a* or a curved surface that is directed outward along the width direction 100*a* as the connecting wall approaches the second side surface 106 along the depth direction 100*b*.

The first side surface 105 is provided with a side flange 105*a*. The side flange 105*a* is comprised of a metal sheet extending from the lower end of the first side surface 105 toward the outer side along the width direction 100*a*, and is formed by folding back the metal sheet toward the back side of the front substrate 10 such that the metal sheet wraps around the back substrate 11. The providing of the side flange 105*a* integrally with the body portion 100 leads to improved durability (wind pressure resistance performance) of the metal roofing member 1 against an external force that will act to warp the metal roofing member 1 to the front side or the back side along a straight line along the width direction 100*a*.

A protruding width W1 of the side flange 105*a* from the first side surface 105 is less than or equal to a protruding width W2 of the second side surface 106 from the first side surface 105 (W1≤W2). Further, the protruding width W1 of the side flange 105*a* from the first side surface 105 is preferably 2 mm or more and 5 mm or less. The protruding width W1 of 2 mm or more can provide the side flange 105*a* with sufficient strength and reliably prevent warping of the front substrate 10. The protruding width W1 of 5 mm or less can avoid decreased strength of the side flange 105*a* due to an increase in the protruding width W1 and maintain good design properties of the metal roofing member 1. In this embodiment, the total width of the metal roofing member 1 is about 908 mm, the protruding width W1 is about 4.5 mm, and the protruding width W2 is about 5.0 mm.

The second side surface 106 is not provided with the flange, because a flange extending from the second side surface 106 is cut off after forming the box-shaped body portion 100.

Returning to FIG. 1, the ridge-side end surface 107 is positioned at one end along the depth direction 100*b* and is adapted to be located on the ridge side when the metal roofing member 1 is placed on the roof base. The ridge-side end surface 107 is provided with a straight portion 107*a* and inclined portions 107*b*. The straight portion 107*a* extends linearly along the width direction 100*a*. The inclined portions 107*b* are disposed on both sides of the straight portion 107*a* so as to connect the straight portion 107*a* and the second side surface 106. Further, each of the inclined portions 107*b* extends obliquely with respect to the straight portion 107*a* so as to be directed toward the eave side (the other end side along the depth direction 100 b) as the inclined portion 107*b* approaches the second side surface 106.

As particularly shown in FIGS. 1 and 3, the straight portion 107*a* of the ridge-side end surface 107 is provided with a ride-side flange 107*c*. The ridge-side flange 107*c* is comprised of a metal sheet extending outward along the depth direction 100*b* from the lower end of the ridge-side end surface 107, and is formed by folding back the metal sheet toward the back side of the front substrate 10 such that the metal sheet wraps around the back substrate 11. As with the side flange 105*a* described above, a protruding width of the ridge-side flange 107*c* from the ridge-side end surface 107 is preferably 2 mm or more and 5 mm or less.

Each of the inclined portions 107*b* of the ridge-side end surface 170 is not provided with the flange, because the flange extending from each inclined portion 107 is cut off after forming the box-shaped body portion 100, as in the second side surface 106 as described above. However, each of the inclined portions 107*b* may be provided with a flange similar to the ridge-side flange 107*c*.

The eave-side end surface 108 is located at the other end along the depth direction 100*b* and is adapted to be located on the eave side when the metal roofing member 1 is placed on the roof base. In the metal roofing member 1 according to this embodiment, the eave-side end surface 108 is structured only by a straight portion extending along the width direction 100*a*. However, the eave-side end surface 108 may have any other shape.

The eave-side flange 108 is comprised of a metal sheet extending outward along the depth direction 100*b* from the lower end of the eave-side end surface 108 and is formed by folding back the metal sheet toward the back side of the front substrate 10 such that the metal sheet wraps around the back substrate 11. As with the side flange 105*a* and the ridge-side flange 107*c* described above, a protruding width of the eave-side flange 108*a* from the eave-side end surface 108 is preferably 2 mm or more and 5 mm or less.

The ridge-side flange 107*c* and the eave-side flange 108*a* extend along the width direction 100*a* and prevent warping of the metal roofing member 1 along the direction crossing the width direction 100*a*.

Hereinafter, the three flanges of the side flange 105*a*, the ridge-side flange 107*c* and the eave-side flange 108*a* are collectively referred to simply as a flange. As can be seen from FIGS. 3 and 4, a major part of each outer edge 10*c* of the metal sheet that makes up the front substrate 10 forms a tip of the flange. Each outer edge 10*c* is positioned on the inner side than a side end 109*a* of the flange. Although the outer edge 10*c* is often not coated or plated, the outer edge 10*c* can be prevented from being directly exposed to external corrosion factors, such as rainwater and sea salt particles, by virtue of the fact that the outer edge 10*c* is positioned on the inner side than the side end 109*a*.

The folded-back portion of the flange is provided with a back end 109*b* that will be in contact with the roof base. A distance D1 (see FIG. 4) between the back end 109*b* and the back surface 11*a* of the back substrate 11 is 1 mm or more and 4 mm or less. The distance D1 between the back end 109*b* and the back surface 11*a* of 1 mm or more can prevent infiltration of water between the back end 109*b* and the back surface 11*a* due to the capillary phenomenon. Further, the distance D1 between the back end 109*b* and the back surface 11 a of 4 mm or less can avoid a decrease in the strength of the flange.

The shape of the folded-back portion of the flange may be just one single folding through bending at 180° with constant curvature, as illustrated in FIGS. 3 and 4, or may involve repeated folding after being folded-back, as illustrated in FIG. 6(*a*). Further, the folding-back of the flange 110 may be accomplished by bending at 90°, as illustrated in FIGS. 6(*b*)-(*d*). Even if the folding-back of the flange is performed by either bending at 90° or at 180°, the curvature radius at the bent portion of the metal sheet in the flange is preferably 0.5 mm or more. The curvature radius of 0.5 mm or more can prevent generation of cracks in the coated film and the plated layer of the metal sheet due to bending, and thus prevent peeling of the coated film and the plated layer and corrosion of the metal sheet.

Next, FIG. 7 is an explanatory view showing a roofing structure and a roofing method using the metal roofing members 1 in FIGS. 1 to 4. In FIG. 7, the roofing structure and the roofing method are described using the three metal roofing members 1, but it should be noted that actually more metal roofing members 1 are used for the roofing structure and the roofing method.

As shown in FIG. 7, a plurality of metal roofing members 1 are arranged on the roof base while abutting their sides against each other in a direction 2 parallel to the eave. Here, since the second side surface 106 is arranged at a position protruding from the first side surface 105, each metal roofing member 1 is arranged on the roof base while abutting the second side surface 106 against the second side surface 106 of the other metal roofing member 1. In this state, the first side surfaces 105 of the respective metal roofing members 1 are spaced apart from each other, so that water permeated between the first side surfaces 105 will smoothly flow down to the eave side. Therefore, water pooled between the metal roofing members 1 can be reduced, thereby reducing any possibility of corrosion of the metal roofing members 1, as compared with an embodiment where a plurality of metal roofing members 1 are arranged while abutting the entire side surfaces against each other.

As described above, the first side surface 105 is provided with the side flange 105*a*. By providing the side flange 105*a*, the strength of the metal roofing member 1 is improved. As described with reference to FIG. 4, the protruding width W1 of the side flange 105*a* is less than or equal to the protruding width W2 of the second side surface 106, in order to reliably abut the second side surfaces 106 of the respective metal roofing members 1 against each other. When the protruding width W1 of the side flange 105*a* is equal to the protruding width W2 of the second side surface 106, the second side surfaces 106 as well as the side flanges 105*a* are abutted. Even if the side flanges 105*a* of the respective metal roofing members 1 are abutted against each other or the side flanges 105*a* are brought close to each other, the amount of water pooled between the side flanges 105*a* is suppressed, because the distance D1 between the back end 109*b* of each side flange 105*a* and the back surface 11*a* is 4 mm or less. Further, since the metal roofing member 1 is provided with the flanges (the side flange 105*a*, the ridge-side flange 107*c*, and the eave-side flange 108*a*), a gap is formed between the back substrate 11 and the roof base. As a result, the amount of water remaining on the back side of the metal roofing member 1 can be reduced, so that any risk of corrosion can be further reduced.

When the side portions of the metal roofing materials 1 are abutted against each other, a space extending along the depth direction 100*b* is formed on the side of the first side surface 105 of each metal roofing material 1 and above the side flange 105*a*. However, since the second side surfaces 106 of the respective metal roofing materials 1 are abutted against each other, this space is closed by the abutting portion of the second side surfaces 106. Therefore, it is possible to reduce the amount of water entering the ridge side of the metal roofing material 1 through this space.

Water may enter the ridge side of the metal roofing member 1 due to strong wind or the like. However, since the ridge-side end surface 107 is provided with the inclined portions 107*b*, water entering the ridge side is guided by the inclined portion 107*b* to the abutted portion of the second side surfaces 106, and the water can be gradually discharged to the eave side through the butted portion.

A plurality of metal roofing members 1 are arranged on the roof base while the metal roofing member 1 on the ridge side is superposed on the metal roofing member 1 on the eave side, in the eave-ridge direction 3.

In this case, the metal roofing member 1 on the ridge side is overlapped with the metal roofing member 1 on the eave side such that the eave-side end portion (the side end 109*a* of the eave-side flange 108*a*) of the metal roofing member 1 on the ridge side is positioned above the first side surface 105 and the side flange 105*a* of the eave-side metal roofing member 1. When the metal roofing member 1 on the ridge side is overlapped with the metal roofing member 1 on the eave side, for example, an external force such as strong wind will act to warp the metal roofing member 1 on the eave side, starting at the eave-side end portion of the metal roofing material 1 on the ridge side. By overlapping the metal roofing materials 1 as described above, the external force can be withstood by the side flange 105*a* having relatively higher strength, so that the warping of the metal roofing member 1 on the eave side can be suppressed. That is, the wind pressure resistance performance is improved by the arrangement of the metal roofing members 1 as described above.

Further, the metal roofing member 1 on the ridge side is overlapped with the metal roofing member 1 on the eave side such that the second side surface 106 of the metal roofing member on the ridge side is placed above the ridge-side end portion (the side edge 109*a* of the ridge-side flange 107*c*) of the metal roofing substrate 1 on the eave side. The overlap of the metal roofing members 1 in such a way reduces any risk of water entering the ridge side of the metal roofing member 1 on the eave side through the gap between the metal roofing members 1 on the ridge side.

EXAMPLES

Examples are now illustrated. The inventors experimentally produced test members of the metal roofing member 1 under conditions given below.

A coated hot-dip Zn-55% Al plated steel sheet, a coated hot-dip Zn-6% Al-3% Mg plated steel sheet or a coated hot-dip Al plated steel sheet, which has a size of 0.20 mm to 0.6 mm, was used as the material of the front substrate 10.

Glass fiber paper having a size of 0.2 mm, Al metallized paper having a size of 0.2 mm, a PE resin film having a size of 0.2 mm, an Al foil having a size of 0.1 mm or a coated hot-dip Zn-based plated steel sheet having a size of 0.27 mm was used as the back substrate 11.

A two-liquid mixture type foam resin was used as the core material 12. The mixing ratio of a polyol component and isocyanate, phenol or cyanurate component was 1:1, in ratio by weight.

The front substrate 10 was processed to have a predetermined thickness and shape of the roofing member. The back substrate 11 was then disposed on the back side of the front substrate 10 so as to cover the opening of the body portion 100, and the foam resin was injected into the gap between the body portion 100 of the front substrate 10 and the back substrate 11, using a commercially available high-pressure injection machine. Foaming of the resin was accomplished by maintaining the resin for 2 minutes in a mold at which the temperature was adjusted to 70° C. by circulating hot water; subsequently, the roofing member was removed from the mold, and was allowed to stand for 5 minutes at room temperature of 20° C., to complete foaming of the resin.

After complete of the foaming of the resin, the metal sheet extending from a lower edge of the body portion 100 toward the outer direction of the body portion 100 was cut such that the protruding width of the flange (the side flange 105*a*, the ridge-side flange 107*c* and the eave-side flange 108*a*) was 5 mm, and the cut metal sheet was subjected to a bending process by means of a bender to have a predetermined shape. The dimensions of the final metal roofing member 1 were 414 mm×910 mm. The thickness of the final roofing member was in the range of from 3 mm to 8 mm.

For comparison, a specimen of a metal roofing member (conventional structure) was produced by subjecting a 0.3 mm coated hot-dip Zn-55% Al alloy plated steel sheet as the front substrate to inward 90°-bending of the four sides of the steel sheet to have a box shape using a bender, and injecting the foam resin in accordance with the method as described above. Glass fiber paper having a size of 0.2 mm was used as the back substrate of this metal roofing member. The thickness of the roofing member was 6 mm, while other conditions were the same as those described above.

For comparison, the following metal roofing members were also tested: a metal roofing member with no foam resin injected; a roofing member obtained by bonding a commercially available 0.3 mm thermally-insulating polyethylene sheet to a processed front substrate using an adhesive; a concrete roofing tile having a thickness of 6 mm; a clay roof tile having a thickness of 16 mm; and a metal roofing member of mating type that utilized a coated hot-dip Zn-55% Al alloy plated steel sheet (without backing material) having a thickness of 0.35 mm.

Using the above test members, the inventors evaluated: (1) the weight of the roofing member, (2) the bending strength of the roofing member, (3) rainwater pooling, (4) corrosion resistance, (5) heat insulation properties and (6) the amount of rainwater entering the ridge side from the abutted portion. The results are given in the table below.

TABLE 1

Evaluation Results

| No. | Class | Details of Test Members: Height of Body Portion (mm) | Type of Core Material (Resin) | Type of Front Substrate*1 | Thickness of Front Substrate (mm) | Molding Method of Front Substrate*4 | Type of Back Substrate*2 |
|---|---|---|---|---|---|---|---|
| 1 | Exs. | 4 | Urethane | A | 0.27 | (A) | a |
| 2 | | 4 | Urethane | A | 0.27 | (A) | a |
| 3 | | 6 | Cyanurate | C | 0.30 | (A) | c |
| 4 | | 8 | Cyanurate | A | 0.40 | (A) | d |
| 5 | | 8 | Phenol | A | 0.50 | (B) | a |
| 6 | Comp. | 3.5 | Cyanurate | B | 0.30 | (A) | b |
| 7 | Exs. | 6 | Cyanurate | A | 0.35 | — | a |
| 8 | | 6 | Cyanurate | A | 0.25 | (A) | a |
| 9 | | 6 | Cyanurate | A | 0.60 | (A) | a |
| 10 | | 6 | Urethane | B | 0.30 | (A) | b |
| 11 | | 6 | Urethane | B | 0.30 | (B) | b |
| 12 | | 6 | Urethane | B | 0.27 | (A) | e |
| 13 | | 6 | Cyanurate | C | 0.25 | (B) | a |
| 14 | | 6 | Cyanurate | C | 0.35 | (A) | a |
| 15 | | 6 | Cyanurate | C | 0.40 | (A) | a |
| 16 | | 6 | Cyanurate | C | 0.35 | (A) | a |
| 17 | | 6 | No Core Material | C | 0.35 | (A) | a |

| No. | Class | Details of Test Members: Distance D1 (mm) | Flange Bending Portion: Shape of Bending Portion*3 | Curvature Radius (mm) | Protruding Width W1 (mm) | Protruding Width W2 (mm) |
|---|---|---|---|---|---|---|
| 1 | Exs. | 1.0 | (*) | 0.5 | 2 | 2 |
| 2 | | 2.2 | (a) | 0.7 | 4.5 | 5 |
| 3 | | 3.0 | (c) | 0.9 | 4.5 | 5 |
| 4 | | 3.4 | (d) | 0.9 | 4.5 | 5 |
| 5 | | 4.0 | (d) | 1.0 | 5 | 5 |
| 6 | Comp. | 2.5 | (b) | 1.0 | 4.5 | 5 |
| 7 | Exs. | 0 | Bender Bending/Boxed Roof (Conventional Structure) | | | |
| 8 | | 2.5 | (*) | 2.0 | 4 | 5 |
| 9 | | 2.5 | (*) | 0.9 | 1.8 | 1.8 |
| 10 | | 2.5 | (a) | 1.0 | 1.5 | 1.5 |
| 11 | | 2.5 | (*) | 1.0 | 5.3 | 7 |
| 12 | | 2.5 | (*) | 1.0 | 5 | 4.7 |
| 13 | | 0.8 | (*) | 0.25 | 4.5 | 5 |
| 14 | | 4.2 | (d) | 1.0 | 4.5 | 5 |
| 15 | | 2.5 | (*) | 1.0 | 4 | 3 |
| 16 | | 0.4 | (*) | 0.4 | 4.5 | 5 |
| 17 | | — | (d) | 2.0 | 3.5 | 1.0 |

| Evaluation of Roof Member Weight | Evaluation of Bending Strength | Rainwater Pooling Evaluation: Gap between Abutted Roofing Members | Rainwater Pooling Evaluation: Gap of Backing Substrate/Roof .Base | Corrosion Resistance Evaluation: Gap between Abutted Roofing Members | Corrosion Resistance Evaluation: Gap of Backing Substrate/ Roof Base | Heat Insulation Evaluation | Evaluation of Amount of Rainwater Entering Abutted Side Flanges |
|---|---|---|---|---|---|---|---|
| ○ | ○ | ○ | ○ | ○ | ○ | ○ | ○ |
| ○ | ○ | ○ | ○ | ○ | ○ | ○ | ○ |
| ○ | ○ | ○ | ○ | ○ | ○ | ○ | ○ |
| ○ | ○ | ○ | ○ | ○ | ○ | ○ | ○ |
| ○ | ○ | ○ | ○ | ○ | ○ | ○ | ○ |
| ○ | X | ○ | ○ | ○ | ○ | Δ | ○ |
| ○ | X | X | X | X | X | ○ | ○ |
| ○ | X | ○ | ○ | ○ | ○ | ○ | ○ |
| X | Δ | ○ | ○ | ○ | ○ | ○ | ○ |
| ○ | X | ○ | ○ | ○ | ○ | ○ | ○ |
| ○ | Δ | ○ | ○ | ○ | ○ | ○ | ○ |
| X | ○ | ○ | ○ | ○ | ○ | ○ | Δ |
| ○ | X | ○ | X | X | X | ○ | ○ |
| ○ | Δ | ○ | ○ | ○ | ○ | ○ | ○ |
| ○ | ○ | ○ | ○ | ○ | ○ | ○ | X |

TABLE 1-continued

| Evaluation Results | | | | | | | |
|---|---|---|---|---|---|---|---|
| ○ | ○ | ○ | X | X | X | ○ | ○ |
| ○ | Δ | ○ | ○ | ○ | ○ | X | ○ |

*[1]A: coated hot-dip Zn-55% Al plated steel sheet; B: coated hot-dip Zn-6% Al-3% Mg plated steel sheet; and C: coated hot-dip Al plated steel sheet.
*[2]a: glass fiber paper; b: Al metallized paper; c: PE resin film; d: Al foil; and e: coated hot-dip Zn-based plated steel sheet.
*[3](*) is the shape of the flange bent portion in FIG. 3, and (A) to (d) show the shape of the flange bent portion shown in FIG. 6.
*[4](A) shows that the front substrate was formed in a box shape by drawing or bulging as shown in FIG. 1, and (B) shows that the front substrate was formed in a box shape by bending as shown in FIG. 3.
—: not tested.

(1) Evaluation Criteria of Roofing Member Weight

The unit weight of each roofing member was measured and evaluated in accordance with the following criteria. It should be noted that the evaluation was made based on an assumption that a standard 130 N/m$^2$ solar cell module was placed on the roof, using the following evaluation criteria based on the total weight of the entire roof including the roofing member.

O : unit weight of roofing member of less than 250 N/m$^2$; and x : unit weight of roofing member of 250 N/m$^2$ or more.

(2) Measurement and Evaluation Criteria of Bending Strength of Roofing Member

The roofing member was placed on a pair of rod-like members disposed spaced apart from each other by 450 mm, such that the extension direction of the rod-like members was the short direction of the roofing member, and a maximum load was measured using an Autograph, in which case the positions of the rod-like members acted as supporting points and the intermediate position between the rod-like members acted as a force point.

The bending strength of the roofing member was evaluated in accordance with the following criteria.

O : maximum load of 160 N or more;

Δ: maximum load of less than 160 Nmm and 50 N or more; and x : maximum load of less than 50 N.

(3) Evaluation Method and Evaluation Criteria of Rainwater Pooling

A commercially available waterproof sheet was affixed to a surface of a roofing board (a thickness of 12 mm), and four tiers of roofing members were roofed at an inclination angle of 30° by the overlap roofing illustrated in FIG. 7 to produce a simulated roof. The entire simulated roof was sprayed with tap water for 10 minutes to sufficiently wet the entire roof. The simulated roof was then dried by placing the simulated roof for 5 hours in a constant-temperature room at room temperature of 20° C. The gap between the roofing members (vertical connecting portion) in the ridge-eave direction was visually observed to evaluate the dry state. The roofing members were then stripped, and the dry state of the back substrate side of the roofing member and the waterproof sheet surface was visually observed and evaluated.

The dry state was evaluated in accordance with the following criteria:

O : sufficient drying with substantially no observable wetting;

Δ: slight wetting observed; and x : no drying; and wetting observed.

(4) Evaluation Method and Evaluation Criteria of Corrosion Resistance

To simulate the roof obtained by the overlap roofing, three tiers of roofing members were roofed by the overlap roofing illustrated in FIG. 7 to produce a simulated roof. 200 cycles of a combined cycle corrosion test (1 cycle: 5% salt spraying at 35 degrees for 1 hour→drying at 50° C. for 4 hours→wetting for 3 hours at 98% RH and at 50° C.) in accordance with Japanese Industrial Standard Z 2371 were carried out, after which the corrosion state of the abutted portion of two metal roofing members 1 adjacent to each other in the direction 2 parallel to the eave was visually observed. The front substrate 10 of each metal roofing member 1 was stripped off, and the corrosion state of the back side of the front substrate 10 was observed.

Corrosion resistance was evaluated in accordance with the following criteria:

O : substantially no corrosion observed;

Δ: slight corrosion observed; and x : significant corrosion observed.

(5) Evaluation Method and Evaluation Criteria of Heat Insulation Properties

Thermocouples were attached to the surface of the front substrate and the back surface of the roofing board of the simulated roof in which rainwater pooling had been evaluated. Twelve lamps (100/110 V, 150 W) were equidistantly arranged at positions of 180 mm from the surface of the simulated roof. The temperature of the back side of the roofing board after 1 hour of irradiation at a lamp output of 60% was measured by the thermocouples, to evaluate heat insulation properties.

Heat insulation properties were evaluated according to the following criteria:

O : a temperature of the back side of the roofing board of lower than 50° C.;

Δ: a temperature of the back side of the roofing board of from 50° C. to 55° C.; and x : a temperature of the back side of the roofing board of 55° C. or higher.

(6) Measurement Method and Evaluation Criteria of Amount of Rainwater Entering Ridge Side from Abutted Portion of Side Flanges A simulated roof was produced in the same method as that of the above item (3). For the simulated roof, water responsive paper 104 available from Syngenta (Switzerland) was inserted between the roofing material on the eave side and the waterproof sheet, as shown in FIG. 7. The water responsive paper 104 presents yellow color in an initial dry state, and as the water responsive paper 104 is contacted with water, the color of the contacted part is instantly changed to navy blue color. Based on the degree of color change, the entering of rainwater was evaluated according to the following criteria.

For the degree of rainwater entering, water was sprayed for 7 minutes under an environment of a wind speed of 30 m/s on the simulated roof to simulate the situation where the roof was exposed to storm. The amount of rainwater at this time was 4,000 mL/min per 1 m$^2$.

O : substantially no color change of the water responsive paper observed and substantially no entering of rainwater observed;

Δ: slight color change of the water responsive paper observed and slight entering of rainwater observed; and x : remarkable color change of the water responsive paper observed and remarkable entering of rainwater observed.

In the case of Nos. 13 and 16 in Table 1, in which the distance D1 between the back end 109*b* of the flange and the back surface of the back substrate 11 was less than 1 mm, rainwater was pooled in the gap portion between the back substrate 11 and the roof base, so that the corrosion resistance of the front substrate positioned underneath was impaired. In the case of No. 14 where the distance D1 was more than 4 mm, the bending strength was decreased, and rainwater was pooled in the gap portion between the roofing members abutted against each other, so that the corrosion resistance was impaired. These results demonstrated that it was advantageous to set the distance D1 between the back end 109*b* of the flange and the back surface of the back substrate 11 to be 1 mm or more and 4 mm or less.

In each of Nos. 9 and 10, the protruding width W1 of the flange was less than 2 mm, so that the bending strength was insufficient. In No. 11 the protruding width W1 was more than 5 mm, so that the bending strength was decreased. These results demonstrated that it was advantageous to set the protruding width W1 of the flange to be 2 mm or more and 5 mm or less.

In each of Nos. 12 and 15, the protruding width W1 of the side flange 105*a* was more than or equal to the protruding width W2 of the second side surface 106, so that the second side surfaces were not abutted against each other and the gap was thus formed, and as result, rainwater entered the ridge direction from the opening of the abutted portion of the first side surfaces. These results demonstrated that it was advantageous to set the protruding width W1 to be more than or equal to W2 to allow the second side surfaces to closely adhere to each other, thereby suppressing rainwater entering the eave side from the opening portion generated at the first side surface portion due to a wind storm.

In each of Nos. 8 and 13, the thickness of the front substrate was less than 0.27 mm, so that the bending strength was insufficient. In No. 9, the thickness of the front substrate was more than 0.5 mm, so that the evaluation of the roofing member weight was poor (x). These results demonstrated that it was advantageous to set the thickness of the metal sheet making up the front substrate 10 to be 0.27 mm or more and 0.5 mm or less.

In the case of each of Nos. 13 and 16 where the curvature radius was less than 0.5 mm, the front substrate 10 was made of the coated hot-dip Al plated steel sheet, so that cracks were generated in the coated film and the plated layer, and as a result, corrosion was generated at the abutted portion between the roofing members and the evaluation rating of corrosion resistance was poor. These results demonstrated that it was advantageous to set the curvature radius of the bent portion of the metal sheet to be 0.5 mm or more when using the metal sheet having the coated film and/or the plated layer.

In No. 6, the thickness of the body portion 100 (roofing member) was less than 4 mm, so that the evaluation of the bending strength was poor (x). The heat insulating performance was slightly lowered and evaluated as (Δ). These results demonstrated that it was advantageous to set the height of the body portion 100 to be 4 mm or higher. Although not particularly shown in Table 1, the organic mass of the core material 12 can be prevented from becoming excessive by setting the height of the body portion 100 to be 8 mm or lower, thereby allowing certification of noncombustible material to be more reliably obtained.

In No. 12, the back substrate 11 was the coated hot-dip Zn-based plated steel sheet which was not lightweight, so that the evaluation of roofing member weight was poor. This result demonstrated that it was advantageous to use a lightweight material such as aluminum foil, aluminum metallized paper, aluminum hydroxide paper, calcium carbonate paper, a resin film or glass fiber paper as the back substrate 11.

In No. 17 having no core material, the bending strength was insufficient and the evaluation of warp was poor, as well as the heat insulation properties were significantly deteriorated.

The inventors carried out a wind pressure resistance test on the roofing members in accordance with Japanese Industrial Standard A 1515. That is, the presence or absence of breakage in a test member when pressed in a pressing process was evaluated using a dynamic wind pressure tester.

A coated hot-dip Zn-55% Al plated steel sheet having a thickness of 0.27 mm and an aluminum sheet having a thickness of 0.5 mm were used as the material of the front substrate 10. These materials were subjected to bulging processing to produce the body portion 100. Glass fiber paper as the back substrate 11 was disposed on the back side of the front substrate 10 so as to cover the opening of the body portion 100, and a cyanurate resin was injected into the gap between the front substrate 10 and the back substrate 11, using a commercially available injection machine. Foaming of the resin was accomplished by holding the resin for 2 minutes in a mold at which the temperature was adjusted to 70° C. by circulating hot water; subsequently, the roofing member was removed from the mold, and was allowed to stand for 5 minutes under conditions of temperature of 20° C., to complete the foaming of the resin. The thickness of the roofing member was 5 mm. The metal sheet extending from a lower edge of the body portion 100 toward the outer direction of the body portion 100 was cut such that the width of the flange was 5 mm, and the metal sheet was processed to the bent shape of FIG. 6(*a*) using a bender to have a width of the bent portion of 3.0 mm, a bent height of 3.0 mm and bending R of 1.0 mm.

Wind pressure resistance was evaluated on the basis of a breaking pressure at the time of induced breakage. When the coated hot-dip Zn-55% Al plated steel sheet having a thickness of 0.27 mm was used as the material of the front substrate 10, the breaking pressure was a negative pressure of 6,000 $N/m^2$ or more, whereas when the aluminum sheet having a thickness of 0.5 mm was used as the material of the front substrate 10, the breaking pressure was a negative pressure of 5,000 $N/m^2$ or more and less than 6,000 $N/m^2$. That is, it was found that improved wind pressure resistance can be achieved even if an aluminum sheet is used, and that further improved wind pressure resistance can also be achieved when a steel sheet is used. Work hardening of the peripheral wall portion 102 derived from bulging is more notably presented in the steel sheet than in the aluminum sheet; it is believed that this difference in hardness of the peripheral wall portion 102 brings about the difference in evaluation results in the wind pressure resistance test.

According to such a metal roofing member 1, and the roofing structure and roofing method that utilize the metal roofing member 1, the metal roofing member 1 is configured to be arranged on the roof base while abutting the second side surface 106 of the metal roofing member 1 against a second side surface 106 of other metal roofing member 1. Therefore, this can allow reduction of water pooled between the metal roofing members, and also allow reduction of water entering the ridge side of the metal roofing member 1.

Further, since the first side surface 105 is provided with the side flange 105*a*, the strength of the metal roofing member 1 can be improved.

Further, the ridge-side end surface 107 includes the inclined portions 107*b* which are provided on both sides of the straight portion 107*a* so as to connect the straight portion 107*a* and the second side surface 106, and which each extends so as to be inclined to the straight portion 107*a* such that each inclined portion 107 is directed to the eave side as it approaches the second side surface 106. Therefore, water entering the ridge side can be guided to the abutted portion of the second side surfaces 106 by the inclined portions 107*b*, and the water can be gradually discharged to the eave side through the abutted portion.

Furthermore, since the straight portion 107*a* of the ridge-side end surface 107 is provided with the ridge-side flange 107*c*, warping of the metal roofing member 1 along the direction crossing the width direction 100*a* can be reduced.

Moreover, since the eave side end surface 108 is provided with the eave-side flange 108*a*, warping of the metal roofing member 1 along the direction crossing the width direction 100*a* can be reduced. Also, the flange 108*a* provided on the straight portion of the eave-side end surface 108 will be a portion where a wind pressure is applied. This portion will tend to generate partial warpage due to strong wind and to generate a gap between the upper and lower roofing members. However, the flange 108*a* suppresses generation of the gap and improves durability (wind pressure resistance performance).

In particular, the surface rigidity can be increased by providing the flanges 107*a*, 108*b* and 105*a* which surround the four sides of the roofing member. As a force applied to the lower roof pressed by the tightened upper roofing member is increased, neither the upper roof nor the lower roof is easily deformed. As a result, the durability (wind pressure resistance performance) is improved. In addition, the flanges 107*a*, 108*b* and 105*a* which surround the four sides of the roof member have effects of improving the flatness of the roofing member itself and of suppressing initial warping and twist, and the gaps between the upper and lower roofing members generated due to the warping and twist.

Further, since the body portion 100 includes the peripheral wall portion 102 comprised of a wall surface that is continuous in the circumferential direction of the front substrate 10, any the possibility of water entering the body portion 100 can be reduced.

Further, the protruding width W1 of the flange (the side flange 105*a*, the ridge-side flange 107*c* and the eave-side flange 108*a*) is 2 mm or more and 5 mm or less, and hence the flange can be imparted with sufficient strength, and the design properties of the metal roofing member 1 can be maintained satisfactorily.

The metal sheet as the material of the front substrate 10 is made of the hot-dip Zn-based plated steel sheet, the hot-dip Al plated steel sheet, the hot-dip Zn-based plated stainless steel sheet, the hot-dip Al plated stainless steel sheet, the stainless steel sheet, the Al sheet, the Ti sheet, the coated hot-dip Zn-based plated steel sheet, the coated hot-dip Al plated steel sheet, the coated hot-dip Zn-based plated stainless steel sheet, the coated hot-dip Al plated stainless steel sheet, the coated stainless steel sheet, the coated Al sheet or the coated Ti sheet. Therefore, the concern of corrosion of the metal roofing member can be more reliably reduced.

Further, since the the metal sheet making up the front substrate 10 has a thickness of 0.27 mm or more and 0.5 mm or less, the strength required for the roofing member can be sufficiently ensured, and the weight of the metal roofing member 1 can be prevented from becoming excessively large. Such a configuration is particularly useful when equipment such as a solar cell module, a solar water heater, an air conditioner outdoor unit or snow melting equipment is provided on the roof.

Further, the bent portion of the metal sheet included in the flange has a curvature radius of 0.5 mm or more. Therefore, it is possible to avoid the generation of cracks in the coated film and the plated layer of the metal sheet due to bending, so that corrosion of the metal sheet can be more reliably avoided.

Furthermore, the body portion 100 has a height h of 4 mm or more and 8 mm or less, the certification of noncombustible material can be more surely obtained while maintaining the heat insulating properties and strength.

Further, the body portion 100 is formed by subjecting the metal sheet to drawing or bulging processing, and is made of the hot-dip Zn-based plated steel sheet, the hot-dip Al plated steel sheet, the hot-dip Zn-based plated stainless steel sheet, the hot-dip Al plated stainless steel sheet, the stainless steel sheet, the Al sheet, the Ti sheet, the coated hot-dip Zn-based plated steel sheet, the coated hot-dip Al plated steel sheet, the coated hot-dip Zn-based plated stainless steel sheet, the coated hot-dip Al plated stainless steel sheet or the coated stainless steel sheet. Therefore, the hardness of the peripheral wall portion 102 can be improved by work hardening, and better wind pressure resistance performance can be achieved.

Moreover, the weight of the metal roofing member 1 can be prevented from being excessively large, because the back substrate 11 comprises or comprised of the aluminum foil, aluminum metallized paper, aluminum hydroxide paper, calcium carbonate paper, the resin film or glass fiber paper.

Furthermore, the metal roofing member 1 on the ridge side is arranged by overlapping with the metal roofing member 1 on the eave side such that the eave-side end portion of the metal roofing member 1 on the ridge side is positioned above the first side surface 105 and the side flange 105*a* of the metal roofing member 1 on the eave side. Therefore, it is possible to withstand an external force by the side flange 105*a* having relatively higher strength, so that warping of the metal roofing member 1 on the eave side can be suppressed.

In addition, the second side surface 106 of the metal roofing member 1 on the ridge side is positioned above the ridge-side end portion of the metal roofing member 1 on the eave side. Therefore, it is possible to reduce any risk that water enters the ridge side of the metal roofing member 1 on the eave side through the gap between the metal roofing members 1 on the ridge side.

What is claimed is:

1. A metal roofing member that is arranged on a roof base, the metal roofing member having a ridge side and an eave side when the metal rooting member is placed on the roof base, and the metal roofing member comprising:

a front substrate made of a metal sheet, the front substrate comprising a body portion formed in a box shape;

a back substrate arranged on a back side of the front substrate, the back substrate being configured to cover an opening of the body portion; and a core material filled between the body portion and the back substrate;

wherein the body portion comprises: first side surfaces and second side surfaces, each of the second side surfaces being adapted so as to be located on the ridge side of one of the first side surfaces when the metal roofing member is placed on the roof base, each of the second side surfaces being arranged at a position protruding toward an outer side along a width direction of the body portion than the one of the first side surfaces;

wherein each of the first side surfaces comprises a side flange, the side flange being formed by folding back the metal sheet toward the back side of the front substrate such that the metal sheet wraps around the back substrate, the metal sheet extending from a lower end of the first side surfaces toward the outer side along the width direction;

wherein the side flange comprising a back end that is configured to contact the roof base;

wherein a distance between the back end of the side flange and a back surface of the back substrate is 1 mm or more and 4 mm or less;

wherein a protruding width of the side flange from one of the first side surfaces is equal to or less than a protruding width of one of the second side surfaces from the one of the first side surfaces; and wherein the metal roofing member is configured to be arranged on the roof base while abutting at least one of the second side surfaces against a second side surface of another metal roofing member.

2. The metal roofing member according to claim 1, wherein the body portion comprises a ridge-side end surface located on the ridge side when the metal roofing member is placed on the roof base; and wherein the ridge-side end surface comprises a straight portion extending along the width direction between two sides; and inclined portions provided on both sides of the straight portion, each of the inclined portions connecting the straight portion and one of the second side surfaces, and extending so as to be inclined to the straight portion such that each of the inclined portions is directed to the eave side as it approaches the one of the second side surfaces.

3. The metal roofing member according to claim 2, wherein the straight portion of the ridge-side end surface comprises a ridge-side flange, the ridge-side flange being formed by folding back the metal sheet toward the back side of the front substrate such that the metal sheet wraps around the back substrate, the metal sheet extending from a lower end of the ridge-side end surface toward the outer side along the width direction of the body portion;

wherein the ridge-side flange comprising a back end that is configured to contact the roof base; and wherein a distance between the back end of the ridge-side flange and the back surface of the back substrate is 1 mm or more and 4 mm or less.

4. The metal roofing member according to claim 1, wherein the body portion comprises an eave-side end surface located on the eave side when the metal roofing member is placed on the roof base; and wherein the eave-side end surface comprises an eave-side flange, the eave-side flange being formed by folding back the metal sheet toward the back side of the front substrate such that the metal sheet wraps around the back substrate, the metal sheet extending from a lower end of the eave-side end surface toward the outer side along the width direction of the body portion;

wherein the eave-side flange comprising a back end that is configured to contact the roof base; and wherein a distance between the back end of the eave-side flange and the back surface of the back substrate is 1 mm or more and 4 mm or less.

5. The metal roofing member according to claim 1, wherein the body portion comprises a peripheral wall portion comprised of a wall surface that is continuous in a circumferential direction of the front substrate.

6. A method for producing the metal roofing member according to claim 5, wherein the metal sheet, which is a material of the front substrate, comprises a hot-dip Zn-based plated steel sheet, a hot-dip Al plated steel sheet, a hot-dip Zn-based plated stainless steel sheet, a hot-dip Al plated stainless steel sheet, a stainless steel sheet, an Al sheet, a Ti sheet, a coated hot-dip Zn-based plated steel sheet, a coated hot-dip Al plated steel sheet, a coated hot-dip Zn-based plated stainless steel sheet, a coated hot-dip Al plated stainless steel sheet or a coated stainless steel sheet; and wherein the method comprises subjecting the metal sheet to drawing or bulging processing to form the body portion.

7. The metal roofing member according to claim 1, wherein the protruding width of the side flange from the one of the first side surfaces is 2 mm or more and 5 mm or less.

8. The metal roof member according to claim 1, wherein the metal sheet, which is a material of the front substrate, comprises a hot-dip Zn-based plated steel sheet, a hot-dip Al plated steel sheet, a hot-dip Zn-based plated stainless steel sheet, a hot-dip Al plated stainless steel sheet, a stainless steel sheet, an Al sheet, a Ti sheet, a coated hot-dip Zn-based plated steel sheet, a coated hot-dip Al plated steel sheet, a coated hot-dip Zn-based plated stainless steel sheet, a coated hot-dip Al plated stainless steel sheet, a coated stainless steel sheet, a coated Al sheet or a coated Ti sheet.

9. The metal roofing member according to claim 8, wherein the metal sheet making up the front substrate has a thickness of 0.27 mm or more and 0.5 mm or less.

10. The metal roofing member according to claim 8, wherein a bent portion of the metal sheet included in the side flange has a curved radius.

11. The metal roofing member according to claim 1, wherein the body portion has a height of 4 mm or more and 8 mm or less.

12. The metal roofing member according to claim 1, wherein the back substrate comprises an aluminum foil, aluminum metallized paper, aluminum hydroxide paper, calcium carbonate paper, a resin film or glass fiber paper.

13. A roofing structure comprising a plurality of metal roofing members, each of the plurality of metal roofing members having a ridge side and an eave side when placed on a roof base, and each of the plurality of metal roofing members comprising:

a front substrate made of a metal sheet, the front substrate comprising a body portion formed in a box shape;

a back substrate arranged on the back side of the front substrate, the back substrate being configured to cover an opening of the body portion; and a core material filled between the front substrate and the back substrate;

wherein the body portion comprises: first side surfaces and second side surfaces, each of the second side surfaces being adapted so as to be located on the ridge side of one of the first side surfaces when the metal roofing member is placed on the roof base, each of the second side surfaces being arranged at a position protruding toward an outer side along a width direction of the body portion than the one of the first side surfaces;

wherein each of the first side surfaces comprises a side flange, the side flange being formed by folding back the metal sheet toward the back side of the front substrate such that the metal sheet wraps around the back substrate, the metal sheet extending from a lower end of the first side surfaces toward the outer side along the width direction;

wherein the side flange comprises a back end, the back end being in contact with the roof base;

wherein a distance between the back end of the side flange and a back surface of the back substrate is 1 mm or more and 4 mm or less; and wherein a protruding width of the side flange from one of the first side surfaces is equal to or less than a protruding width of one of the second side surfaces from the one of the first side surfaces; and wherein the plurality of metal roofing members are arranged on the roof base while abutting at least the second side surfaces against each other.

14. The roofing structure according to claim 13, wherein one of the plurality of metal roofing members on the ridge side is arranged by overlapping with an another of the plurality of metal roofing members on the eave side such that an eave-side end portion of the one of the plurality of metal roofing members is positioned above one of the first side surfaces and the side flange of the another of the plurality of metal roofing members.

15. The roofing structure according to claim 14, wherein one of the second side surfaces of the one of the plurality of metal roofing members is positioned above a ridge-side end portion of the another of the plurality of metal roofing members.

16. A roofing method using a plurality of metal roofing members, each of the plurality of metal roofing members having a ridge side and an eave side when the metal rooting member is placed on a roof base, and the metal roofing member comprising:

a front substrate made of a metal sheet, the front substrate comprising a body portion formed in a box shape;

a back substrate arranged on the back side of the front substrate, the back substrate being configured to cover an opening of the body portion; and a core material filled between the front substrate and the back substrate;

the body portion comprising: first side surfaces and second side surfaces, each of the second side surfaces being adapted so as to be located on the ridge side of one of the first side surfaces when the metal roofing member is placed on the roof base, each of the second side surfaces being arranged at a position protruding to an outer side along a width direction of the body portion than the one of the first side surfaces;

each of the first side surfaces comprising a side flange, the side flange being formed by folding back the metal sheet toward the back side of the front substrate such that the metal sheet wraps around the back substrate, the metal sheet extending from a lower end of the first side surfaces toward the outer side along the width direction;

the side flange comprising a back end, the back end being in contact with the roof base;

a distance between the back end of the side flange and a back surface of the back substrate being 1 mm or more and 4 mm or less; and a protruding width of the side flange from one of the first side surfaces being equal to or less than a protruding width of one of the second side surfaces from the one of the first side surfaces;

wherein the method comprises arranging the plurality of metal roofing members on the roof base while abutting at least the second side surfaces against each other.

17. The roofing method according to claim 16, wherein the method further comprising arranging one of the plurality of metal roofing members on the ridge side by overlapping with an another of the plurality of metal roofing members on the eave side such that an eave-side end portion of the one of the plurality of metal roofing member is positioned above one of the first side surfaces and the side flange of the another of the plurality of metal roofing members.

18. The roofing method according to claim 17, wherein, when arranging the one of the plurality of metal roofing members by overlapping with the another of the plurality of metal roofing members, one of the second side surfaces of the one of the plurality of metal roofing members is positioned above a ridge-side end portion of the another of the plurality of metal roofing members.

* * * * *